United States Patent [19]

Handler et al.

[11] Patent Number: 4,967,916

[45] Date of Patent: Nov. 6, 1990

[54] POST AND JOINT CONSTRUCTION

[75] Inventors: Milton E. Handler, Northbrook; Herbert Baisch, Palatine, both of Ill.

[73] Assignee: Hirsh Company, Skokie, Ill.

[21] Appl. No.: 512,035

[22] Filed: Apr. 13, 1990

Related U.S. Application Data

[63] Continuation of Ser. No. 339,172, Apr. 17, 1989, abandoned.

[51] Int. Cl.[5] ..... A47B 7/00

[52] U.S. Cl. ..... 211/187; 108/111; 108/144; 211/182; 211/186

[58] Field of Search ..... 211/187, 186, 188, 194, 211/182; 108/111, 107, 144; 403/312, 310, 300

[56] References Cited

U.S. PATENT DOCUMENTS

| | | | |
|---|---|---|---|
| Re. 27,186 | 10/1971 | Ferdinand et al. . | |
| Re. 27,200 | 10/1971 | Ferdinand et al. . | |
| 2,889,186 | 6/1959 | Ferdinand et al. . | |
| 2,939,589 | 6/1960 | Handler et al. . | |
| 3,099,891 | 8/1963 | Handler et al. . | |
| 3,229,790 | 1/1966 | Shayne . | |
| 3,255,722 | 6/1966 | Ferdinand et al. . | |
| 3,276,403 | 10/1966 | Ferdinand et al. . | |
| 3,749,974 | 11/1969 | Ferdinand et al. . | |
| 3,771,466 | 11/1973 | Ferdinand et al. . | |
| 4,165,698 | 8/1979 | Ferdinand et al. . | |
| 4,233,912 | 11/1980 | Ferdinand et al. . | |
| 4,335,973 | 6/1982 | Beck et al. | 403/300 |
| 4,344,716 | 8/1982 | Sigal | 403/312 X |
| 4,699,343 | 11/1987 | Handler et al. . | |
| 4,711,183 | 12/1987 | Handler et al. . | |

FOREIGN PATENT DOCUMENTS

| | | | |
|---|---|---|---|
| 570503 | 7/1945 | United Kingdom | 211/187 |

*Primary Examiner*—Carl D. Friedman
*Assistant Examiner*—Daniel Hulseberg
*Attorney, Agent, or Firm*—Dressler, Goldsmith, Shore, Sutker & Milnamow, Ltd.

[57] ABSTRACT

A corner support post for shelving is provided in the form of an elongate member of sheet metal. The member has two side portions that are oriented generally perpendicular to each other, that each extend at about a 45 degree angle from a central wall, and that each define laterally offset, parallel walls. Each side portion has a vertical margin defining a generally cylindrical configuration. Identical posts are adapted to be aligned in end-to-end abutting registration relationship and fastened together with connecting plates.

6 Claims, 1 Drawing Sheet

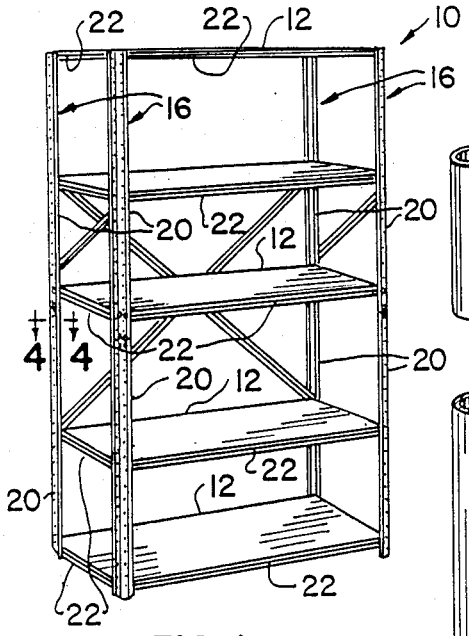
FIG. 1
FIG. 2
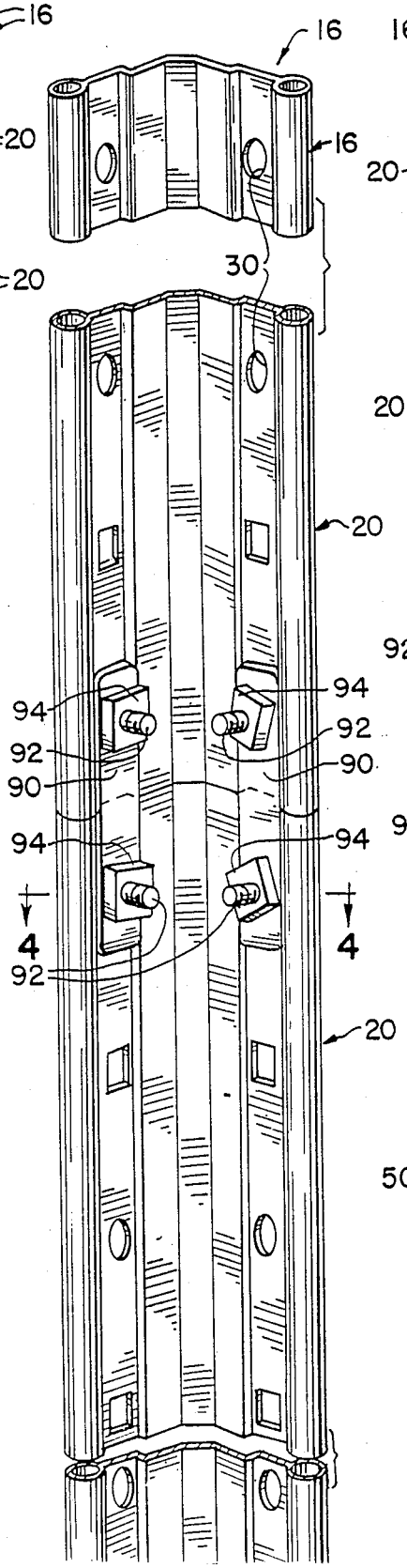
FIG. 3
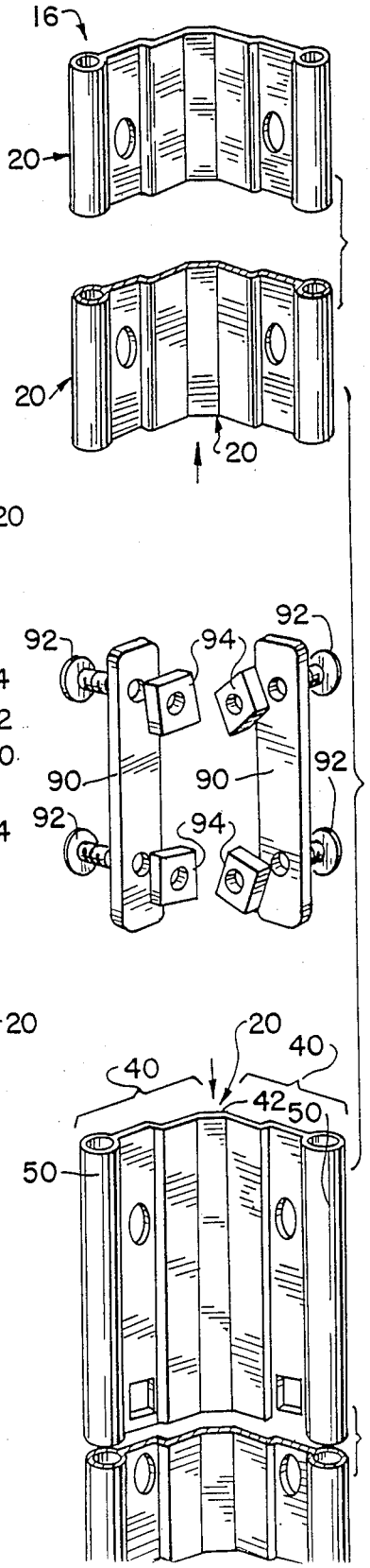
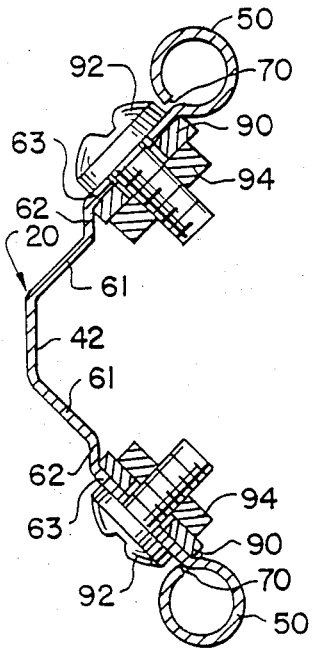
FIG. 4

POST AND JOINT CONSTRUCTION

This is a continuation of application Ser. No. 07/339,172 filed Apr. 17, 1989, now abandoned.

TECHNICAL FIELD

This invention relates in general to a column, standard, or post for use with shelving and the like.

BACKGROUND OF THE INVENTION AND TECHNICAL PROBLEMS POSED BY THE PRIOR ART

It is common to provide shelving fabricated from sheet metal. Typically, support posts are provided at the corners of the shelving, and such posts are also commonly fabricated from sheet metal.

In order to reduce the cost of such shelving, some manufacturers attempt to minimize the thickness of the sheet metal that is used. However, to the extent that the sheet metal thickness is reduced, the rigidity and load-carrying capacity of the shelving may be undesirably reduced. Accordingly, it would be desirable to provide an improved post construction that would accommodate the use of thinner sheet metal while still providing sufficient rigidity and load-carrying capability.

On thin sheet metal post structures, the edges of the sheet metal may define sharp edges which might be bothersome to a person who is handling the shelving or who accidentally brushes up against the shelving. Thus, it would be desirable to provide an improved shelving support post in which such thin edges are minimized if not eliminated.

Some shelving products are typically provided to a user in a package of disassembled pieces. The pieces are designed and fabricated for ease of customer assembly. With such "knock-down" type shelving, it would be desirable to provide a design in which the lengths of the shelving support post could be reduced so as to accommodate smaller packaging. Accordingly, it would be desirable to provide means for connecting smaller lengths of posts together to form a longer column.

It would also be advantageous if such an improved post construction accommodated the creation of a substantially rigid connection between two shorter length posts.

Further, it would be beneficial if the improved post structure was relatively easily and readily assembled by the user.

Finally, it would be advantageous if the means for connecting the shorter length posts were relatively simple to fabricate and had a relatively low manufacturing cost.

SUMMARY OF THE INVENTION

A corner support post for shelving and the like is provided in the form of an elongate member of sheet metal. The member has two side portions that are generally perpendicular to each other, that each define laterally offset, parallel walls, and that each have a vertical margin defining a generally cylindrical configuration to rigidify the member and provide a smooth surface.

In a preferred embodiment, the member has a planar central wall having two vertical side margins, a pair of planar first side walls each extending laterally outwardly at an angle of about 45 degrees from a different one of the vertical side margins of the central wall, a pair of second side walls each extending laterally outwardly at an oblique angle from a different one of the first side walls, and a pair of planar third side walls each extending laterally outwardly at an oblique angle from a different one of the second side walls. Each third side wall is oriented in a plane offset from, and generally parallel to, one of the second side walls.

A pair of generally cylindrical configurations each extend from a different one of the third side walls so that a plane extending from one of the first side walls would be substantially tangent to one of the cylindrical configurations. The cooperative structural relationship among the one cylindrical configuration, the one third side wall, and the one second wall define a receiving channel for a fastening plate.

Two identical posts can then be arranged in an end-to-end abutting registration relationship. A plate is provided with a first portion disposed in the channel of the first post and with a second portion disposed in the channel of the second post. Fastening means, such as nuts and screws, can be used to secure the plate to each of the posts and thereby join the posts together in the end-to-end relationship.

Numerous other advantages and features of the present invention will become readily apparent from the following detailed description of the invention, from the claims, and from the accompanying drawings.

BRIEF DESCRIPTION OF THE DRAWINGS

In the accompanying drawings forming part of the specification, in which like numerals are employed to de like parts throughout the same, FIG. 1 is a perspective view of a modular shelving assembly employing four corner posts in accordance with the teachings of the present invention;

FIG. 2 is an enlarged, fragmentary, rear, perspective view of two corner posts fastened together in accordance with the principles of one aspect of the present invention;

FIG. 3 is an exploded perspective view of the assembled components illustrated in FIG. 2; and FIG.4 is a greatly enlarged, cross-sectional view taken generally along the plane 4—4 in FIG. 2.

DESCRIPTION OF THE PREFERRED EMBODIMENT

While this invention is susceptible of embodiment in many different forms, this specification and the accompanying drawings disclose only one specific form as an example of the use of the invention. The invention is not intended to be limited to the embodiment so described, and the scope of the invention will be pointed out in the appended claims.

A modular shelving system, assembly, or unit is designated generally by reference numeral 10 in FIG. 1. The unit 10 includes a plurality of generally horizontally disposed shelves 12 which are supported by four corner support columns or standards 16. Each column or standard 16, in the particular embodiment illustrated in FIG. 1, includes two identical posts 20 arranged in an end-to-end abutting registration relationship.

Each shelf 12 can be placed at any desired height and secured to the four support columns 16 by suitable means, such as with conventional screws and nuts. To this end, each shelf 12 may be provided with a flange 22 which defines, at its corners, one or more apertures (not visible) for receiving the mounting screw which can be inserted through a selected aperture 30 in the column 16 (FIG. 2).

Other conventional or special attachment means may be provided on each shelf 12 and/or the post 20 of the columns 16 for mounting the shelves 12. The details of such conventional or special shelf mounting means form no part of the present invention.

Each post 20, as best illustrated in FIGS. 3 and 4, is an elongate member of sheet metal having two side portions or sides 40 that are oriented generally perpendicular to each other and that extend at about a 45 degree angle from a central wall 42. Each side portion 40 has a generally cylindrical configuration 50 to rigidify the post 20 and provide a smooth surface which reduces, if not substantially elminates, the likelihood of the edge of the post 20 snagging articles carried past the post or cutting a person handling the post or brushing against the post.

As best illustrated in FIG. 3, the sides 40 of the post 20 are preferably identical. Further, as best illustrated in FIG. 4, each side portion of the post 20 includes a planar first side wall 61 which extends laterally outwardly at angle of about 45 degrees from a vertical side margin of the central wall 42. A planar second side wall 62 extends laterally outwardly at an oblique angle from the first side wall 61. A planar third side wall 63 extends laterally outwardly at an oblique angle from the second side wall 62. The third side wall 63 is oriented in a plane offset from, and generally parallel to, the first side wall 61.

As best illustrated in FIG. 4, the sheet metal of the post 20 has two distal side edges 70 which each lie on the locus of the cylindrical configuration 50. In the preferred embodiment illustrated, each cylindrical configuration 50 has more than one half of the exterior diameter located to one side of a plane defined by the associated third wall 63.

Preferably, however, a portion of the cylindrical configuration 50 projects somewhat on the other side of the plane. In the particular embodiment illustrated, the cylindrical configuration 50 has a diameter such that a plane extending from the first side wall 61 is substantially tangent to the cylindrical configuration 50. A receiving channel is thus defined by the cooperative structural relationship of the cylindrical configuration 50, the third side wall 63, and the second side wall 62. A plate 90 can be received within each channel as best illustrated in FIGS. 2–4. Fastening means, such as screws and nuts 92 and 94, respectively, are provided for securing the plates 90 to the two posts 20 arranged in the end-to-end abutting registration relationship to form the shelving support standard or column 16.

In a preferred form of the invention, the sheet metal of each post 20 is substantially uniform in thickness. The sheet metal thickness is about one-eighth of the outer diameter of the cylindrical configuration 50. Further, the exterior diameter of the cylindrical configuration 50 is about one-fourth of the length of one of the side portions wherein the side portion length includes the associated cylindrical configuration 50 and is measured along a plane perpendicular to the other side portion of the post 20.

Preferably, as best illustrated in FIG. 4, the sheet metal distal edge 70 on each side of the post 20 lies on the locus of the cylindrical configuration 50 adjacent the third wall 63, and the third wall 63 is located between the distal edge 70 and the other side portion 40 of the post 20.

The novel post construction of the present invention provides a relatively rigid and light-weight member for use in supporting shelves in a shelving assembly Further, the post structure accommodates the end-to-end alignment of identical posts to provide longer shelving support standards or columns as may be required The novel post structure accommodates quick and easy fastening of post sections together.

Finally, the novel cylindrical configuration along each vertical margin of the post functions to define, in part, a receiving channel for the connecting plate as well as to provide increased rigidity and a smooth surface that minimizes the likelihood of snagging or scratching other objects or people.

From the foregoing, it will be observed that numerous variations and modifications may be effected without departing from the true spirit and scope of the novel concept of the invention. It is, of course, intended to cover by the appended claims all such modifications as fall within the true spirit and scope of the claims.

What is claimed is:

1. A corner support post for shelving and the like comprising:

an elongate member of sheet metal having first and second surfaces and further having two side portions that (1) generally define an interior right angle with said first surface facing inwardly toward, and receiving a corner of, a shelf and (2) generally define an exterior reflex angle with said second surface facing away from said shelf;

each one of said elongate member side portions having:

a planar first side wall arranged in a substantially perpendicular relationship with the other side portion first side wall and arranged for being positioned adjacent the shelf;

a planar second side wall extending outwardly from said first side wall;

a planar third side wall extending from said second side wall, said third side wall being oriented in a plane offset outwardly from, and generally parallel to, said first side wall; and an edge defined by said sheet metal and a generally hollow, cylindrical configuration formed in said sheet metal extending from said planar third side wall to said edge, said cylindrical configuration being formed to curve relative to said interior right angle to locate said edge adjacent said sheet metal second surface so that said second surface on the third side wall is located between said edge and said shelf, said cylindrical configuration also extending toward said shelf from said third side wall so that a plane defined by, and extending from, said first surface on said first side wall is substantially tangent to said cylindrical configuration wherein a receiving channel is defined by said first surface and the cooperative structural relationship among said cylindrical configuration, said third side wall, and said second side wall.

2. The corner support post in accordance with claim 1 in which said post is a first post; and further including:

a second post identical to said first post and arranged in an end-to-end abutting registration relationship with said first post;

a plate having a first portion disposed in the channel of the first post and a second portion disposed in the channel of the second post; and fastening means for fastening said plate to each of said posts.

3. The corner support post in accordance with claim 1 in which each said cylindrical configuration has more than one-half of the exterior diameter located to one side of a plane defined by an adjacent one of said third side walls.

4. The corner support post in accordance with claim 1 in which the thickness of said sheet metal is substantially uniform and is about one-eighth of the outer diameter of said cylindrical configuration.

5. The corner support post in accordance with claim 1 in which the length of one of said side portions, inclusive of the associated said cylindrical configuration and as measured along a plane perpendicular to the other side portion, is about four times the exterior diameter of the associated cylindrical configuration.

6. The corner support post in accordance with claim 1 further including a planar central wall connecting said two side portions, said central wall being disposed generally at an angle of 45 degrees relative to each said first side wall.

* * * * *